US009421813B2

(12) United States Patent
Marino et al.

(10) Patent No.: US 9,421,813 B2
(45) Date of Patent: Aug. 23, 2016

(54) STYLOGRAPHIC PEN WITH PRECIOUS MATERIAL

(71) Applicant: DELTA S.R.L., Aversa (IT)

(72) Inventors: Gennaro Marino, Aversa (IT); Ciro Matrone, Aversa (IT)

(73) Assignee: DELTA S.R.L., Aversa (IT)

( * ) Notice: Subject to any disclaimer, the term of this patent is extended or adjusted under 35 U.S.C. 154(b) by 63 days.

(21) Appl. No.: 14/389,590

(22) PCT Filed: Mar. 22, 2013

(86) PCT No.: PCT/EP2013/056161
§ 371 (c)(1),
(2) Date: Sep. 30, 2014

(87) PCT Pub. No.: WO2013/144038
PCT Pub. Date: Oct. 3, 2013

(65) Prior Publication Data

US 2015/0071694 A1 Mar. 12, 2015

(30) Foreign Application Priority Data

Mar. 30, 2012 (IT) ..... RM2012A0130

(51) Int. Cl.

| | |
|---|---|
| ***A47L 13/32*** | (2006.01) |
| ***B43K 1/02*** | (2006.01) |
| ***B43K 8/22*** | (2006.01) |
| ***B43K 5/18*** | (2006.01) |
| ***B43K 29/00*** | (2006.01) |

(52) U.S. Cl.
CPC ... *B43K 1/02* (2013.01); *B43K 5/18* (2013.01); *B43K 8/22* (2013.01); *B43K 29/00* (2013.01)

(58) Field of Classification Search
CPC ..... B43K 1/02; B43K 8/22
USPC ..... 401/1–2
See application file for complete search history.

(56) References Cited

U.S. PATENT DOCUMENTS

| | | | | | |
|---|---|---|---|---|---|
| 2,051,337 | A * | 8/1936 | Horn | B43K 1/02 | 15/446 |
| 2,289,998 | A * | 7/1942 | Salz | B43K 1/02 | 401/224 |
| 4,748,460 | A * | 5/1988 | Piatt | B41J 3/28 | 346/143 |

FOREIGN PATENT DOCUMENTS

| | | | | |
|---|---|---|---|---|
| CN | 2478785 | | 2/2002 | |
| CN | 201086498 | | 7/2008 | |
| DE | 3401725 | | 8/1985 | |
| DE | 4317758 | | 12/1994 | |
| DE | 102010006686 | | 8/2011 | |
| GB | 723484 | A * | 2/1955 | B43K 1/02 |
| GB | 2 259 061 | | 3/1993 | |
| JP | 02175195 | | 7/1990 | |
| JP | 9-300876 | | 11/1997 | |
| JP | 2002-101928 | | 4/2002 | |

OTHER PUBLICATIONS

European Search Report cited in PCT/EP2013/056161 mailed Jun. 3, 2013.

* cited by examiner

*Primary Examiner* — Jennifer C Chiang
(74) *Attorney, Agent, or Firm* — Nixon & Vanderhye P.C.

(57) ABSTRACT

Stylographic pen provided with a pen nib including an aeration hole, a slit, a tip and a precious material plate made of any precious material, wherein the plate made of precious material is placed in proximity to the aeration hole and in proximity to the ink present in the pen nib.

10 Claims, 5 Drawing Sheets

STYLOGRAPHIC PEN WITH PRECIOUS MATERIAL

CROSS RELATED APPLICATION

This application is the U.S. national phase of International Application No. PCT/EP2013/056161 filed 22 Mar. 2013 which designated the U.S. and claims priority to Italian Patent Application No. RM2012A000130 filed 30 Mar. 2012, the entire contents these applications are incorporated by reference.

FIELD OF THE ART

The present invention refers to a new type of stylographic pen provided with a pen nib, whose constituent elements are assembled in a manner such to improve the technical characteristics of the stylographic pen, such as the quality of the writing and durability, and at the same time confer the pen itself pleasant aesthetic characteristics while keeping the price reasonable.

STATE OF THE ART

Stylographic pens are a particular type of pen with reservoir whose use for writing has been known for many years.

Even if there were various predecessors of the stylographic pens, the first recognized invention relative to one such pen type dates back to 1827, when the French government granted the stylographic pen patent. In the subsequent years, many other patents were developed which made the stylographic pen one of the most widespread writing instruments. In particular, the inventions that increased the use of this pen type were those regarding the golden nib pen with the tip made of iridium, ebonite and finally the introduction of the free-flow ink.

Most of the subsequent inventions nevertheless revealed limits and in particular offered poor writing quality. The main cause of the problems was related to the conduction of the ink from the reservoir to the pen nib. In general, there were problems regarding capillarity, excessive viscosity of the ink and sensitization to the temperature variations.

For these wide-ranging reasons, starting from 1883 (the year in which the first truly functional stylographic pen model was developed) an entire series of inventions were developed, aimed at improving the quality of the writing of this widely used and common instrument. Regarding this, the invention of Pelikan, which in 1929 made a plunger loading device which is still used today alongside the interchangeable plastic cartridge used in modern stylographic pens, should be borne in mind.

Although in the last fifty years, digital writing has passed from the virtual sphere to that of everyday tangibility, fountain pens are still commonly used, especially the stylographic pens which are increasingly used for signing important documents. Today, indeed, the stylographic pen has also acquired the function of "status symbol", combining high performance characteristics with pleasant, particular aesthetic characteristics. For such purpose, the present patent application intended to describe a new type of stylographic pens provided with a pen nib which in addition to having optimal characteristics of durability over time, is made of a combination of different materials that make the final product precious but at the same time inexpensive, enhancing the chemical-physical properties of the ink with an assembly system adapted to increase the efficiency of the pen itself.

The pen nib indeed represents one of the most important components of the stylographic pen, since it plays the fundamental role of bringing the ink directly onto the page. Given that it is continuously in contact with the ink, the pen nib was traditionally made of gold, in order to obtain a greater resistance to the corrosion exerted by the ink itself. Nevertheless, the evolution of technology over the years has led to steel pen nibs, which have proven to have a passivity and a resistance to corrosion even greater than gold itself or gold alloys. Nevertheless, notwithstanding this important characteristic, the use of pen nibs entirely made of steel has not gained enough popularity, especially due to marketing reasons. Still today, it is commonly thought that the stylographic pen with gold pen nib is an object of greater value, even if technically this element has similar if not inferior characteristics with regard to corrosion phenomena with respect to steel. Indeed, gold is a malleable metal and for this reason a pen nib entirely made of gold is subject to be easily bent and deformed with respect to its steel counterpart. For this reason, over the years various steel pens have been produced being made precious by gold elements decorating the pen itself and the surface of the pen nib. The final properties to be conferred to the entire pen nib also in this case can be considered analogous to those of a pen nib entirely made of steel, since the amount of gold and the manner in which this is combined with steel do not involve substantial variations of the chemical-physical properties nor does the cost or the performance of the pen nib itself substantially change. For such purpose, the present invention intends to describe a new and inexpensive type of stylographic pen provided with a pen nib made of a combination of materials. Such combination confers to the pen nib improved characteristics in terms of writing quality, efficiency and aesthetic qualities, given that the characteristics of all elements and/or materials they are made of are highlighted and applied.

In particular, some of these elements and/or materials, which will be listed below, are assembled to the pen nib in a conformation such to render the ink more fluid and less viscous in proximity to the pen nib, contributing to a substantial improvement of the writing and efficiency of the pen itself, which thus is more durable and efficient over time.

DESCRIPTION OF THE INVENTION

The present invention describes a new type of pen with reservoir, and specifically a new type of stylographic pen. In particular, these new stylographic pens are provided with a pen nib made of a combination of a plurality of materials that are assembled, and generally joined, in a manner such to obtain a pen nib that in addition to having new and pleasant aesthetic characteristics, also confers greater efficiency to the writing of the stylographic pen itself. More in detail, the present invention describes a new type of stylographic pen that is provided with pen nibs whose constituent materials give the pen important improved technical characteristics, such as optimal writing quality, greater durability over time, and also confer pleasant aesthetic qualities alongside a lower cost to the public even though having a portion of the pen nib made of precious elements, with respect to most of the common stylographic pens currently available in the market.

Specifically, the invention described in the present documents provides a new and improved type of stylographic pen, in which the materials constituting the pen nib are elements and/or materials and/or alloys of: gold, steel, titanium and palladium. The present invention also includes different elements with respect to those mentioned above, but which have chemical-physical properties similar to the aforesaid substances and which are well adapted for the object of the present invention.

For such purpose, it is important to observe that materials such as steel and elements such as titanium are characterized by physical properties that make them substances particularly adapted for resistance to mechanical stresses and therefore they are difficult to deform. Said materials are also scarcely susceptible to the corrosion phenomena by ink. Metal elements such as gold and palladium, even if considered precious based on the rarity thereof in nature, on the contrary have a clear malleability and thus can be easily deformed. Nevertheless elements like gold have physical properties that can be considered quite useful for the object of the present invention. Gold, for example, has a relatively low value of specific heat (J/Kg*K), and in particular 128 J/Kg*K. This means that the quantity of heat required for raising the temperature of a unit of mass of gold by a single degree is relatively low. This important characteristic ensures that the material in question heats very easily and quickly when placed in proximity to a heat source. Alongside this characteristic, besides the properties thereof, gold also has a relatively high value of thermal conductivity. In particular, the value of thermal conductivity of gold is 317 W/m*K. This value defines the ratio between the heat flow and the temperature gradient. In other words, it expresses the ability of a substance to transmit heat. This means that the greater the thermal conductivity, the less insulating the material. By joining these two properties, gold is therefore both an element that can be easily heated and a good heat conductor. These characteristics ensure that if the element in question, i.e. gold, is placed at heat sources or in small, relatively warm settings, it will easily heat and equally easily transmit the heat absorbed from the outside to the bodies with which it is in contact. For such purpose, the stylographic pens described in the present invention are provided with a pen nib that has a plate made of precious material, with the aforesaid characteristics, which being close to the ink contained in the pen nib, will tend to heat the ink and keep it fluid when said precious material plate is placed close to a heat source or in small relatively hot settings such as a jacket or the case of the stylographic pen itself. The remaining part of the pen nib object of the present invention is instead made of a material equipped with different chemical-physical characteristics, such as steel or titanium. The pen nib resulting from the particular union of the aforesaid materials according to the present patent application is a pen nib that joins characteristics of high resistance to mechanical stresses if necessary, e.g. in proximity to the tip that presses on the paper sheet, and high thermal conductivity in proximity to the aeration hole of the pen nib itself and the ink present therein. The latter characteristic causes an increase of the fluidity of the ink as well as a substantial diminution of the viscosity thereof. The result is an evident improvement of the quality of the writing of the stylographic pen obtained according to the technique introduced by the present invention. A further aspect not to be underestimated is the aesthetic appearance that is made particular and pleasant due to the presence of the precious material plate made with precious element that is used. The precious element arranged above the steel pen nib will be thermally more effective the wider its surface area, and hence also aesthetically pleasing.

The table below shows the specific heat values and the values of thermal conductivity of some materials used in the present invention, and in particular steel, gold, titanium and palladium.

TABLE 1

| | Steel | Gold | Titanium | Palladium |
|---|---|---|---|---|
| Specific heat (J/Kg*K) | 502 | 129 | 520 | 244 |
| Thermal conductivity (W/m*K) | 57 | 317 | 21.9 | 71.8 |

In order to enhance the characteristics of low specific heat and high thermal conductivity of the element constituting the aforesaid precious material plate, also described in the present invention is a stylographic pen provided with a small electric circuit, inside the pen and hence not visible; by means of two resistors, such circuit heats the precious material plate and the ink contained in the pen nib in order to make it fluid even when the external temperature is particularly low.

The steel pen nib 1 has a bend radius that ranges from 3 to 8 mm.

DESCRIPTION OF THE PREFERRED EMBODIMENTS

Figure 1:
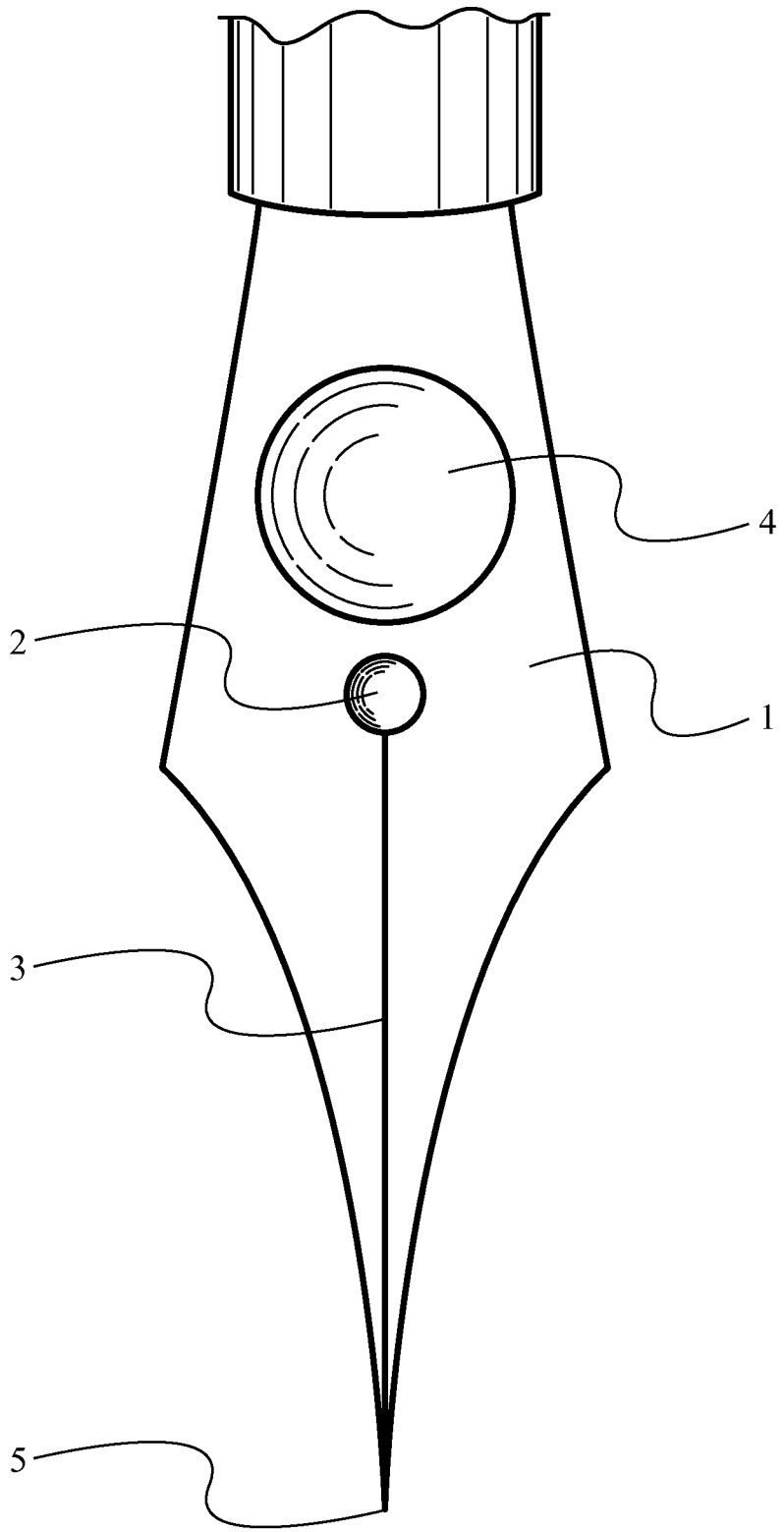
FIG. 1 shows a view of the pen nib 1 illustrating the aeration hole 2, the slit 3, the precious material plate 4 and the tip 5 of the pen nib 1.
Figure 2:
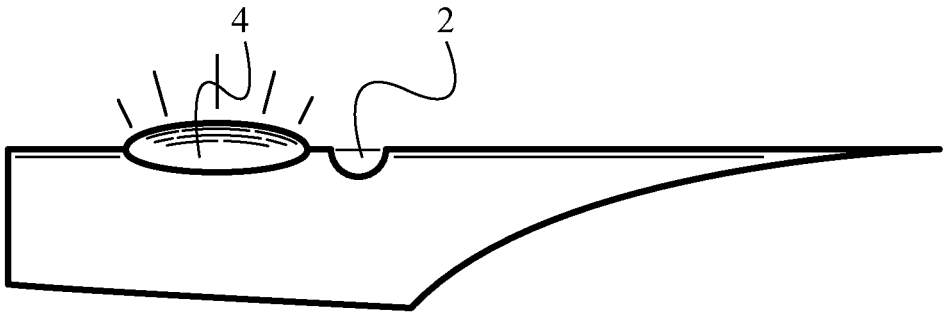
FIG. 2 shows a perspective view of the pen nib 1 in which the precious material plate 4 is assembled to the pen nib 1 by means of fitting.
Figure 3:
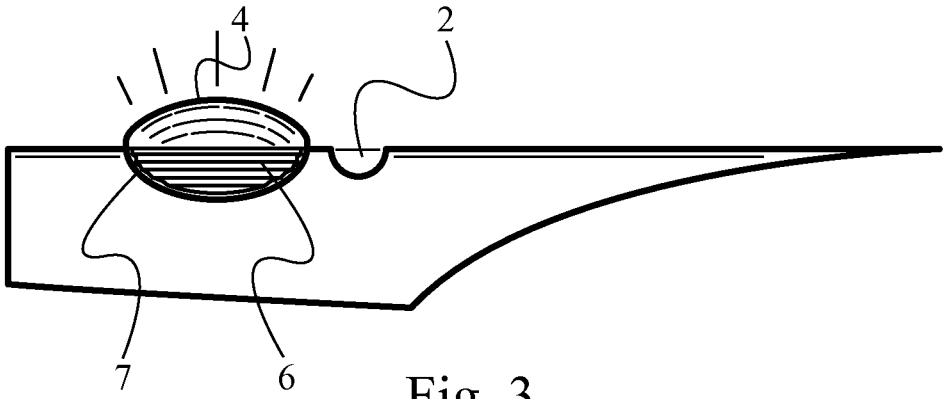
FIG. 3 shows a perspective view of the pen nib 1 in which the precious material plate 4 is provided with a threaded end 6 which allows assembling said precious material plate 4 to the pen nib 1 by means of screwing the threaded end 6 into the threaded cavity 7 present on the pen nib 1.
Figure 4:
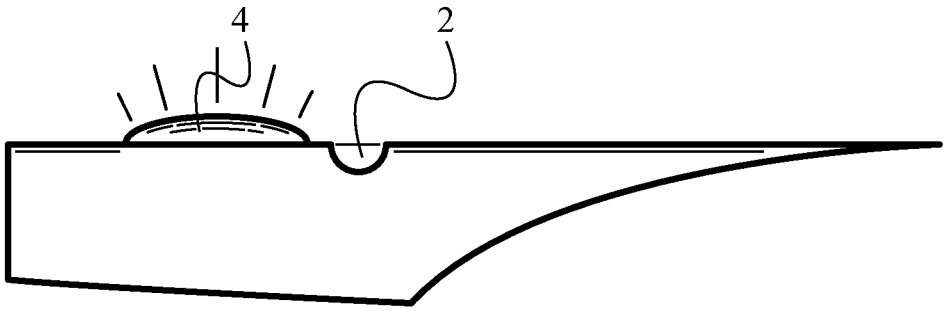
FIG. 4 shows a perspective view of the pen nib 1 in which the precious material plate 4 is joined to the pen nib by means of direct gluing of said precious material plate 4 to the surface of the pen nib 1.

In all embodiments thereof, the stylographic pen described in the present invention has a pen nib 1 whose main constituents are an aeration hole 2, connected to a slit 3 which terminates in the tip 5 of the pen nib 1. On the surface of the pen nib 1 and in proximity to the aeration hole 2, at least one plate made of precious material 4 is present, such plate assembled in different ways to the body of the pen nib 1. Said precious material plate 4 can have various shapes but the mass must be equal to or greater than ⅕ of the mass of the steel of the pen nib.

In a first embodiment, the pen nib 1 has a precious material plate 4 made of a precious material, preferably gold, which is assembled to the body of the pen nib 1 by means of simple fitting. The result that is obtained by means of this simple and known assembly mechanism is a precious material plate 4 that is perfectly and stably mounted on the body of the pen nib 1. In a second embodiment of the present invention, the precious material plate 4 can have various shapes but the mass must be equal to or greater than ⅕ of the mass of the steel of the pen nib 1 itself and it is joined to the pen nib 1 by means of a common mechanism of screwing of the threaded end 6 of the precious material plate 4, inside a cavity 7 also provided with thread in this case. Said cavity 7 is present on the surface of the pen nib 1, centrally or laterally, in any case in proximity to the aeration hole 2.

In a further embodiment, the precious material plate 4 can have various shapes but the overall mass must be equal to or greater than ⅕ of the mass of the steel of the pen nib; the plate is assembled to the surface of the body of the pen nib 1 by means of simple gluing.

Figure 5:
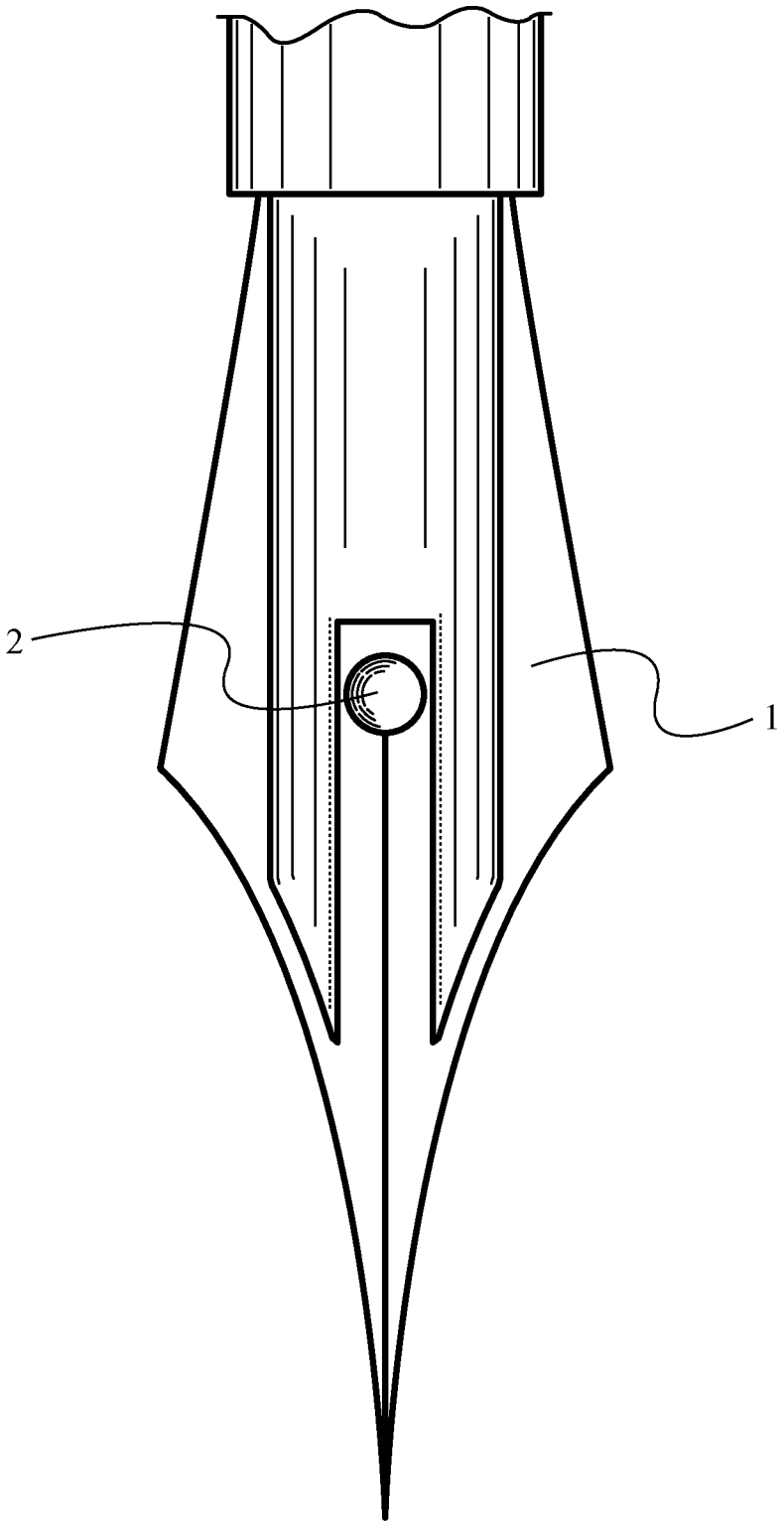
FIG. 5 shows a perspective view of the pen nib 1 when the precious material plate 4 has an overturned U-shaped form in which the lower ends of the precious material plate 4, i.e. directed towards the tip 5 of the pen nib 1, enclose the aeration hole 2.
Figure 6:
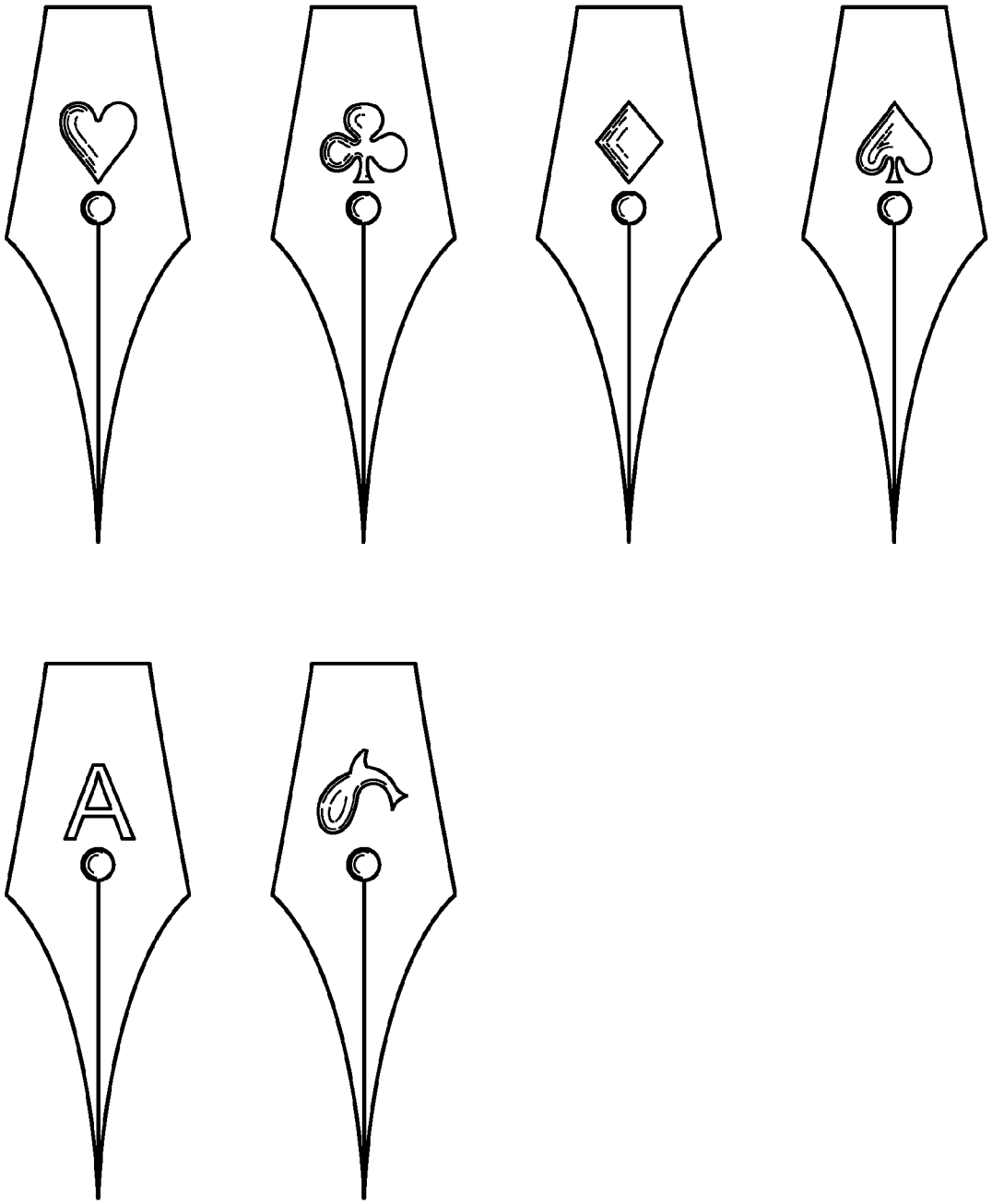
FIG. 6 shows various perspective views of the pen nib 1 in which the precious material plate 4 acquires various shapes, such as: the shape of an ace of hearts, an ace of clubs, an ace of diamonds, an ace of spades, a letter of the alphabet, and a dolphin. In any case, the surface area and the overall mass of the precious material plate remains considerable and never less than ⅕ of the mass in steel of the pen nib.
Figure 7:
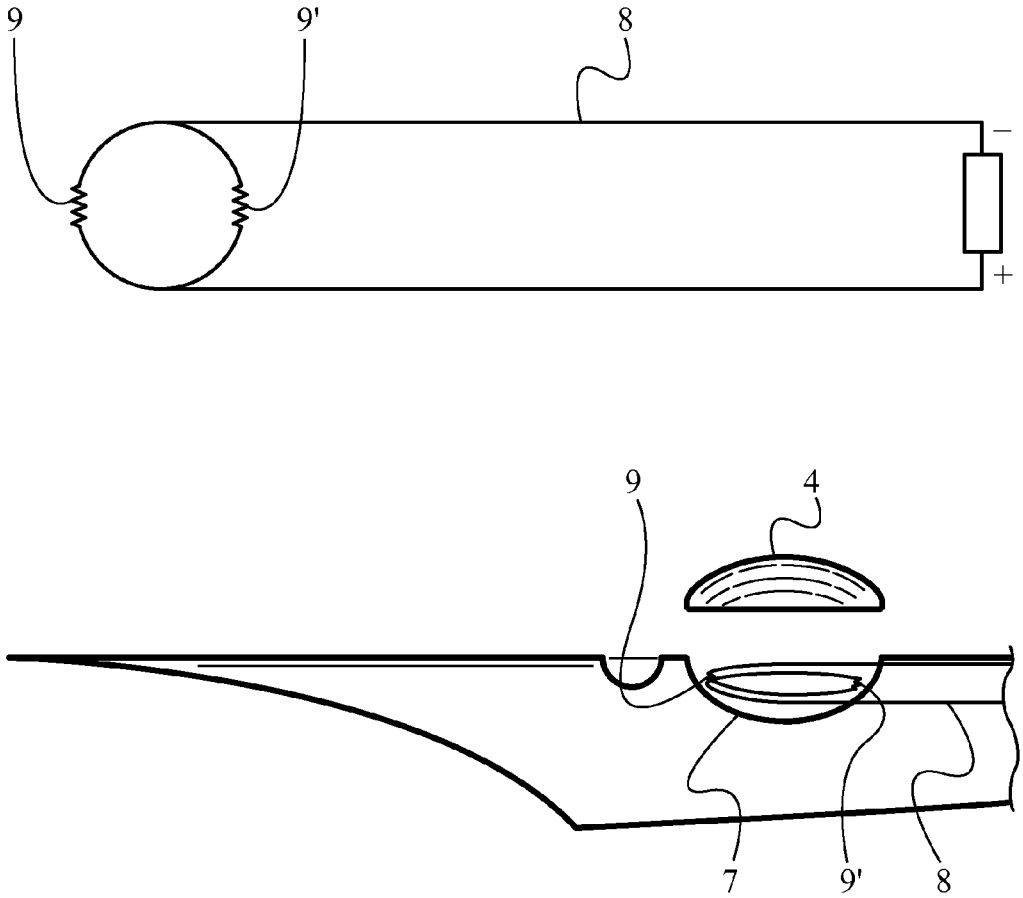
FIG. 7 shows an exploded view of the pen nib 1 in which a wire portion of the small electric circuit 8 is visible, when said wire is wound as a coil in proximity to the cavity 7 and precious material plate 4 and has two resistors 9 and 9'. The battery for supplying power to said resistors 9 and 9' is placed inside the body of the pen 1 itself.

The circular form of the precious material plate 4 present on the pen nib 1 is merely indicative and non-limiting of the range of the present invention. Indeed, the stylographic pen object of the present invention can have various appearances in the embodiments thereof (see FIG. 5 and FIG. 6), i.e. the precious material plate 4 can have a regular or irregular geometry and have the shape of any closed curve. In the various embodiments of the present invention, the elements constituting the pen nib can be coupled in various ways. For example, in the case in which the materials constituting the pen nib 1 are selected from among steel, gold, titanium and palladium, preferably it is possible to obtain a pen nib 1 that has a precious material plate 4 made of gold and the remaining part made of steel. The advantage of this combination of substances lies in obtaining a pen nib 1 that has a considerable resistance to mechanical stresses, and therefore it is difficult to deform, in zones subject to said stresses; for example said pen nib 1 is non-deformable in proximity to the tip 5 which presses on the sheet when writing. The presence of the precious material plate 4 made of gold, in addition to conferring a pleasant aesthetic aspect to the stylographic pen, also improves the writing quality thereof from a technical standpoint. As stated above, the chemical-physical characteristics of gold, such as low specific heat (129 J/Kg*K) and high thermal conductivity (317 W/m*K) ensure that when this element is placed in proximity to a heat source, it easily heats and equally easily transmits the absorbed heat to the bodies with which it is in direct contact, steel and ink in the specific case. This important aspect of the invention described herein leads to an increase of the fluidity of the ink and a decrease of the viscosity thereof in proximity to the tip 5. This leads to a considerable improvement of the quality and fluidity of the writing.

Analogous results can be obtained by combining palladium with titanium, i.e. obtaining a pen nib 1 with a precious material plate 4 made of palladium and the remaining part made of titanium. Or by combining gold with titanium, i.e. obtaining a pen nib with a precious material plate 4 made of gold and the remaining parts made of titanium, or by obtaining a pen nib 1 with a precious material plate 4 made palladium and the remaining part made of steel.

In a further embodiment of the present invention, the stylographic pen described in the present patent application is provided with a small electric circuit 8 at its interior, made of a switch, externally accessible to the user of the pen, by at least one battery and by at least one resistor 9. The function of this small electric circuit is to heat the precious material plate 4, converting electrical energy into thermal energy, i.e. generating heat in proximity to the ink placed inside the pen nib. The operating mechanism of this kind of circuit can be obtained by arranging the power supply battery of the resistor 9 in any part of the body of the stylographic pen of the present invention. The profile of the circuit in proximity to the precious material plate 4 is of major importance to the heating of the precious material plate 4. More in detail, the wire of the circuit 8 completes a coil path, enclosing the precious material plate 4, adhering also to the walls of the cavity 7. The wire of the circuit 8 also has at the cavity 7, as well as at the material plate 4, at least one resistor 9 which has the function of heating the precious metal material plate when the circuit is closed. The entire circuit 8, the resistor 9 and the power supply battery will not be visible, unless the stylographic pen itself is disassembled.

Alternatively, the resistor 9 can be directly power supplied by a photovoltaic cell placed on the body of the stylographic pen itself, or said photovoltaic cell can power supply the battery itself and this in turn power supply the resistor 9.

The invention claimed is:

1. A stylographic pen comprising:

a steel pen nib an aeration hole, a slit, a tip and at least one precious material plate made of a precious material, wherein said at least one precious material plate is in proximity to the aeration hole, and an electric circuit inside a body of the stylographic pen and comprising at least one resistor and a power supply battery in the body of said stylographic pen and said power supply battery being at least one of a replaceable or rechargeable battery.

2. The stylographic pen according to the claim 1 wherein the electric circuit further comprises a conductive wire inside the pen nib and the wire is coiled and is adherent to a wall of a cavity receiving or adjacent to the at least one precious material plate and is connected to the at least one resistor, and wherein a bend radius of the steel pen nib is in a range of 3 to 8 mm.

3. The stylographic pen according to claim 1, wherein at least one plate is fitted in or adheres to said pen nib.

4. The stylographic pen according to claim 1, wherein the at least one precious material plate is fastened to the pen nib by a threaded end of the at least one plate engaging a threaded cavity on the pen nib.

5. The stylographic pen according to claim 1, wherein said at least one precious material plate is fastened to the pen nib by welding or direct melting of the plate to or on a surface of the pen nib proximate to the aeration hole.

6. The stylographic pen according to claim 1 wherein the at least one precious material plate is formed of a material having a specific heat that differs from a specific heat of the material constituting the pen nib.

7. The stylographic pen according to claim 1 wherein the precious material plate is made of a material having a higher thermal conductivity than the material constituting the pen nib.

8. The stylographic pen according to claim 1 wherein the precious material plate is made of at least one of gold, another precious or semi-precious metal and another portion of the pen nib is made of titanium or steel.

9. The stylographic pen according to claim 1 wherein the precious material plate has a mass equal to at least ⅕ of the mass of the pen nib.

10. A stylographic pen comprising:

a metallic pen nib including an aeration hole, a slit having one end adjacent the aeration hole, a tip adjacent an opposite end of the slit, and a precious metal plate adjacent a side of the aeration hole opposite to the slit, and a heating circuit housed in the stylographic pen, wherein the heating circuit includes a power supply, a resistor and conductors electrically connecting the power supply and the resistor, wherein the resistor is adjacent the precious metal plate.

* * * * *